United States Patent [19]

Nelson

[11] Patent Number: 4,603,291

[45] Date of Patent: Jul. 29, 1986

[54] NONLINEARITY CORRECTION CIRCUIT FOR BANDGAP REFERENCE

[75] Inventor: Carl T. Nelson, San Jose, Calif.

[73] Assignee: Linear Technology Corporation, Milpitas, Calif.

[21] Appl. No.: 624,630

[22] Filed: Jun. 26, 1984

[51] Int. Cl.[4] ..... G05F 3/20

[52] U.S. Cl. ..... 323/315; 323/316; 323/907

[58] Field of Search ..... 363/313, 314, 315, 316, 363/907

[56] References Cited

U.S. PATENT DOCUMENTS

| | | | |
|---|---|---|---|
| 4,032,839 | 6/1977 | Ahmed | 323/316 |
| 4,443,753 | 4/1984 | McGlinchey | 323/315 |
| 4,491,780 | 1/1985 | Neidorff | 323/313 |

*Primary Examiner*—Peter S. Wong
*Assistant Examiner*—Judson H. Jones
*Attorney, Agent, or Firm*—Flehr, Hohbach, Test, Albritton & Herbert

[57] ABSTRACT

A curvature correction circuit for generating an output current of the general form T ln T. When applied as a curvature correction circuit to bandgap references, the circuit precisely offsets the inherent parabolic nonlinearity of such circuits.

8 Claims, 5 Drawing Figures

V1
R2
R1
10
40
A1
42
30
Q2
Q1
I41
I0
I42
R3
VREF
R4
Q43
Q44
R41
Q41
Q42

VREF
51
R54
R55
D51
50
A1
R52
52
30
Q52
R51
I41
I0
I42
Q51
R53
Q43
Q44
R56
D52
R41
Q41
Q42

NONLINEARITY CORRECTION CIRCUIT FOR BANDGAP REFERENCE

BACKGROUND OF THE INVENTION

This invention relates to bandgap references, to bandgap references fabricated as monolithic integrated circuits and, in particular, to a correction circuit for the nonlinear, TlnT error term associated with such bandgap references.

Various systems, such as A/D converters, D/A converters, temperature sensors, measurement systems and voltage regulators use reference circuits to establish accuracy of the system. Typically, the reference is one of two types, a bandgap reference or a zener reference.

Zener diode references require a voltage of perhaps 10 volts to achieve the proper operating range relative to the breakdown voltage of approximately seven volts. However, the trend in the microelectronics industry is to decrease the power supply voltage and to standardize on a single five-volt supply. The effect is to decrease the number of applications for which zener references are suitable. At the same time, the need is for an accurate reference. It is believed that bandgap references are the principal circuits of this type capable of satisfying the dual requirements of accuracy and operating on a single, five-volt supply. However, the requirement for accuracy in the bandgap reference translates into an increasingly stringent requirement of predictable linearity in the temperature coefficient.

At this point, it will be helpful to review the features of a state-of-the-art conventional bandgap reference and an approximation for its output. FIG. 1 schematically illustrates such a reference, in the form of the relatively simple, yet relatively accurate bandgap reference circuit 10 which is the Brokaw cell.

In the Brokaw cell 10, the values of resistors R1 and R2 and the operational amplifier A1 are configured to force NPN transistors Q1 and Q2 to operate at equal collector current levels. Secondly, the ratio, A, of the emitter-junction area of Q1 and Q2 is a value such as 10, so that when Q1 and Q2 are operating at equal collector current levels, the base-emitter voltage, $V_{Be}$, of Q1 will be a predetermined lesser value that the base-emitter voltage of Q2. Third, the voltage drop across R3, $V_{R3}$, is simply $\Delta V_{Be}$, the difference between the base-emitter voltages of transistors Q1 and Q2. As is well known, such a differential voltage is proportional to absolute temperature, that is, it is a "PTAT" voltage, and is of the form:

$$\Delta V_{Be} = \frac{KT}{q} \ln A \tag{1}$$

where A is the selected current density ratio of Q1 and Q2 or, equivalently, is the ratio of the emitter-junction areas of Q1 and Q2, since they are operating at equal current levels. Fourth, because $i_4 = i_1 + i_2 = 2i_2$, the ratio of the voltage drops $V_{R4}/V_{R3}$ for the resistor voltage divider R4 and R3 is given by $G = V_{R4}/V_{R3} = 2R4/R3$.

Also the reference output voltage $V_{OUT}$ at the base of transistor Q2 is the sum of $V_{Be}$ the base-emitter voltage for Q2 and of $V_{R4}$. Since $V_{R4}$ is a multiple of $V_{R3}$, and since $V_{R3}$ is a temperature-dependent (PTAT) voltage, $V_{OUT}$ can be expressed as $$V_{OUT} = V_{Be} + V_{R4} \tag{2}$$

-continued $$= V_{Be} + GV_{R3}$$

$$= V_{Be} + \frac{2R_4}{R_3} \frac{KT}{q} \ln A$$

In practice, at least as a first approximation, a relatively accurate, stable reference output voltage $V_{OUT}$ can be obtained if the ratio of $R_4/R_3$ is selected such that the positive temperature coefficient of the second term of (2) matches, and therefore cancels, the negative temperature coefficient of the first term ($V_{Be}$).

Despite the relatively accurate output obtained with the above-described circuit, there are potentially two sources of temperature-induced curvature in the output of bandgap references.

The first source relates to the use of diffused resistors in bandgap references. Diffused resistors have a very high temperature coefficient, in the order of 1000 to 3000 PPM/°C., which translates into a substantial curvature in the reference voltage. However, the nonlinearity associated with resistors can be eliminated to a great extent by the use of thin film resistors, such as nichrome or sichrome resistors, which have a much lower temperature coefficient.

A second, currently more difficult source of nonlinearity in bandgap references results from an inherent error term of the general form TlnT. This error is evidenced in the complete expression for the output voltage of a bandgap voltage reference, which is:

$$V_{OUT} = C_1 \frac{KT}{q} + V_{go}\left(1 - \frac{T}{T_o}\right) + V_{Beo}\left(\frac{T}{T_o}\right) + \frac{KT}{q} \ln \frac{Ic}{Ico} + \frac{nKT}{q} \ln \frac{T}{T_o} \tag{3}$$

The temperature coefficient is obtained by taking the derivative with respect to temperature:

$$\frac{dV_{out}}{dt} = \frac{C_1 K}{q} - \frac{V_{go}}{T_o} + \frac{V_{Beo}}{T_o} + \left(\frac{nKT}{q}\right)\left(\frac{1}{T}\right) - \frac{nK}{q} \ln \frac{T}{T_o} + \frac{K}{q} \ln \frac{Ic}{Ico} = f(T), \tag{4}$$

where:

$C_1$=constant,

K=Boltzmann's constant, q=charge on electron, $V_{go}$=extrapolated bandgap voltage of silicon, $T_o$=temperature at which $V_{Beo}$ is measured, $V_{Beo}$=base emitter voltage of a silicon transistor measured at a collector current of Ico at temperature To, Ic=collector operating current of transistor (nominally a function of temperature), n=constant, ~2, and T=Kelvin temperature.

All the terms in the derivative except the last two are independent of temperature. In practice, the sum of all terms can be made equal to zero at room temperature to approximate zero temperature coefficient in the reference. Because of the last two terms, however, the temperature coefficient would still not be zero at all temperatures.

Specifically, consider $(nK/q)\ln(T/T_o)$, the next to the last term of equation (4). At −55° C., 25° C., and 125° C., this term takes on values −49 μV/°C., 0, and +49 μV/°C. This represents a 98 μV/°C. shift in the reference temperature coefficient over the range −55° C. to +125° C. The reference voltage itself is approximately 1.2 volts, which yields a shift in reference drift of approximately 82 ppM/°C., and limits the usefulness of the basic bandgap in high accuracy, wide temperature range applications.

The second nonlinear term, $(K/q)\ln(I_c/I_{co})$ can be used to cancel the first nonlinear term, because the signs are reversed. Total cancellation would occur when $I_c=I_{co}(T/T_o)^n$. This power expression for the operating current of the transistor is one way of correcting the nonlinearity of a bandgap reference, but the circuit required to implement the correction is complicated and the widely varying operating current can present problems for circuit operation.

A parabolic correction circuit is used in the temperature sensor circuit described by Pease, in a paper entitled "A New Celsius Temperature Sensor", published and presented at the *Circuits and Systems Conference,* May 1, 1982, in Pasadena, Calif. The sensor uses a $T_2$ generator circuit developed by applicant to correct for the TlnT nonlinearity term. The $T^2$ generator circuit is shown as system 20 in FIG. 2. Briefly stated, a current which is proportional to absolute temperature (IPTAT) is fed through the transistors Q1 and Q2 whereas the current summed into Q3 is constant versus temperature. The relationships are such that the correction current I4 through Q4 is a product $(I_1 \times I_2)/I_3$, where $I_1$ and $I_2$ are the IPTAT's through Q1 and Q2 and $I_3$ is the current across Q3. That is, $I_4 \sim IPTAT^2 \sim T^2$. This $T^2$ curvature compensation circuit is designed to be added to the temperature sensor circuit. It should be noted, however, that the $T^2$ curvature compensation circuit 20 is not a true bandgap correction circuit. While the circuit 20 is the simplest, perhaps most effective $T_2$ temperature curvature compensation circuit of which applicant is aware and while the $T^2$ term does approximate the error term of bandgap references, bandgap references nonetheless deviate from the $T^2$ term, especially at lower temperatures. As a result, a much better overall correction for bandgap nonlinearity would be provided by using a real TlnT term.

Unfortunately, very little has been done to address the nonlinearity problem. The only known exception, in which a circuit has been used to generate a TlnT term involves an A/D converter, with bandgap reference and correction circuit. The correction circuit is complex and, essentially irrelevant to the relatively simple yet effective curvature correction circuit which is the object of the present invention.

Thus, with few exceptions, curvature correction techniques are not available for bandgap references. This is unfortunate: the nonlinear TlnT error term limits the minimum temperature coefficient obtainable with the reference because the temperature coefficient itself is thus a function of temperature. Significant improvement in bandgap reference performance with regard to temperature drift will be achieved by eliminating this nonlinear term.

SUMMARY AND OBJECTS OF THE INVENTION

Objects of the Invention

It is an object of the present invention to provide a circuit and method for generating an output current having the form, TlnT.

It is another object of the present invention to provide a circuit and method which readily interfaces with and/or is incorporated into convention bandgap reference circuits for applying a curvature correction current thereto of the general form TlnT.

It is another object of the present invention to provide a circuit and method for generating a curvature correction current of the above-described type in which the non-linear component is optimized relative to the linear component by the selection of conventional transistor parameters.

It is still another object of the present invention to provide a circuit and method for generating an output current which readily interfaces with and/or is incorporated into conventional bandgap reference circuits for applying a curvature correction current thereto of the general form TlnT, and in which the correction current is defined by a conventional base-emitter differential current of bipolar transistors and the ratio of nonlinear to linear components of the current is optimized by the selection of the ratios of the collector currents and of the emitter areas of the bipolar transistors.

Summary

The above and other objects are implemented in one preferred embodiment in a circuit which includes a pair of first and second bipolar transistors which are adapted, respectively, to receive at the collector thereof a current $I_1$, which is directly proportional to temperature, and $I_2$. The transistors have their bases connected across a selected resistance to provide a current therebetween of the form TlnT. In a preferred embodiment, the collector currents are established by current generators which supply the first current which has the requisite temperature proportionality and the second current which has an essentially zero temperature coefficient.

The circuit has a third bipolar transistor which has its base and emitter connected across the collector and the base of the first transistor for developing across the third transistor the output current of the form TlnT.

In still another embodiment, the present invention comprises in combination first and second sections. The first section comprises a bandgap reference circuit having an output which is substantially a linear function of temperature, and which includes as components thereof a first pair of bipolar transistors for generating an output based upon the difference in their base emitter voltages, and an amplifier feedback loop having an output connected to the base of the transistor pair and having an inverting input. The second section thereof is a curvature correction circuit for the bandgap reference comprising a second pair of first and second bipolar transistors having emitter areas of ratio $(A_2/A_1)$ and having their bases connected across a resistance of selected value R for providing in response to respective collector currents $I_1$ and $I_2$ of ratio $(I_1/I_2)$ applied thereto, a current across the resistance which is proportional to absolute temperature and of the general logarithmic form TlnT. The logarithmic term also includes as components the emitter area ratios and the current ratios of the second transistor pair. As a consequence, that is, by the appropriate selection of the transistor current and area ratios, the nonlinear term of the correction current can be readily optimized relative to the linear term.

DETAILED DESCRIPTION

Figure 3:
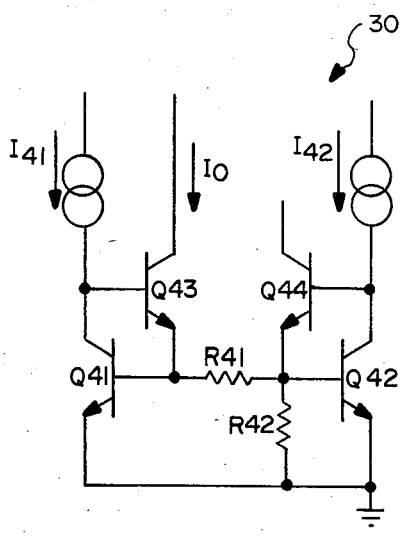
FIG. 3 is a schematic illustration of a preferred embodiment of the curvature correction circuit of the present invention.

FIG. 3 is a schematic of my correction circuit 30 which implements a unique solution for curvature correction of bandgap reference circuits in the form of a TlnT correction term. As shown in FIG. 3, the correction circuit 30 which generates the TlnT correction term uses only four transistors, $Q_{41}$ through $Q_{44}$. This simple circuit can be easily inserted into a bandgap reference by applying the correction output current $I_o$ to the appropriate node of the bandgap reference circuit. As shown, current generators 41 and 42 are used, respectively, to generate an IPTAT current $I_{41}$ and a non-IPTAT current, that is, a current with substantially zero temperature coefficient, $I_{42}$. The form of the output current $I_o$ is determined by the currents associated with the transistors $Q_{41}$ and $Q_{42}$, that is, by the ratio of currents $I_{41}$ and $I_{42}$ and by the ratio, A, of the emitter junction areas of Q41 and Q42. Those skilled in the art will appreciate from analysis of the circuit 30 that the correction current $I_o$ through the transistor Q43 is obtained from $\Delta V_{Be}/R_{41}$, where $\Delta V_{Be}$ is the difference in the base-emitter voltages, $V_{Be}$, of transistors Q41 and Q42. This current takes the form:

$$I_o = \frac{\Delta V}{R1} = \frac{(V_{Be(Q41)} - V_{Be(Q42)})}{R_{41}} \tag{5}$$

$$= \frac{KT}{qR_{41}} \ln\left(\frac{I_{41}}{I_{42}} \frac{A_{42}}{A_{41}}\right)$$

where $A_{41}$ = the emitter area of Q41 and $A_{42}$ = the emitter area of Q42.

Now, as mentioned, $I_{41}$ is proportional to absolute temperature, and in fact is readily made of the form $I_1 = I_oT/T_o$, and $I_{42}$ is independent of temperature. In consequence, the output current $I_o$ is of the form $$I_o = \frac{KT}{qR_{41}} \ln\left(\frac{I_oT}{T_oI_{42}} \frac{A_{42}}{A_{41}}\right) \tag{6}$$

This parabolic function is of the form $$I_o = C_1 T \ln C_2 T, \tag{7}$$

where $C_1 = K/qR41$, and $$C_2 = \frac{I_o A_{42}}{T_o I_{42} A_{41}}$$

The parabolic form of the output correction circuit $I_o$ is exactly the form of the bangap nonlinearity TlnT. Thus, the correction circuit 30 and its associated output correction current $I_o$ can be inserted into the bandgap reference at an appropriate point to cancel the curvature of the reference. The simple, four transistor correction circuit 30 performs its correction function very accurately, is readily incorporated into the bandgap reference cell, and is readily adjusted to the appropriate amount of correction. The important parameters are $R_{41}$; the IPTAT current $I_{41}$; the essentially zero temperature coefficient current (OTC) $I_{42}$; and the area ratio and collector current ratio of transistors Q41 and Q42. The area and current ratios are adjusted so that the current through R41 remains greater than zero at all temperatures. One might expect to be able to change the ratios of the currents or the emitter areas of Q41 and Q42 so that the voltage drop across $R_{41}$ would go negative at certain temperatures. This is inappropriate to the chosen function of the correction circuit 40 because the current through Q43 would then drop to zero. At that particular temperature or temperatures the cell would cease performing its correction function.

To implement curvature correction for a particular reference circuit, the exact value for $I_o$ which gives zero nonlinearity is easily obtained by selection of the value of $R_{41}$. The values of $I_{41}$, $I_{42}$, $A_{41}$, and $A_{42}$ are chosen to insure that $I_o$ never drops to zero, for the reasons discussed above. $I_o$ should, however, be as small as possible so that the nonlinear portion of $I_o$ is as large as possible compared to the linear portion. This is because the nonlinear portion of $I_o$ provides the curvature correction and the linear term is just an additive error term to the bandgap reference. The non-linear term is independent of the ratios of the currents and the ratios of the emitter areas of the transistors $Q_{41}$ and $Q_{42}$, while the linear term is very much a function of these ratios and parameters. As a consequence and to minimize the linear component and maximize the nonlinear component relative thereto, the ratio $I_{41}/I_{42}$ should be selected to be just larger than the ratio $A_{42}/A_{41}$ at the lowest operating temperature of the bandgap reference. This ability to optimize the contribution of the non-linear correction term or component relative to the inherent linear term or component, and the relative ease of this adjustment, is a primary advantage of the present invention, in addition to the advantage of generating a TlnT correction term using a relatively simple, easily implemented circuit.

Figure 1:
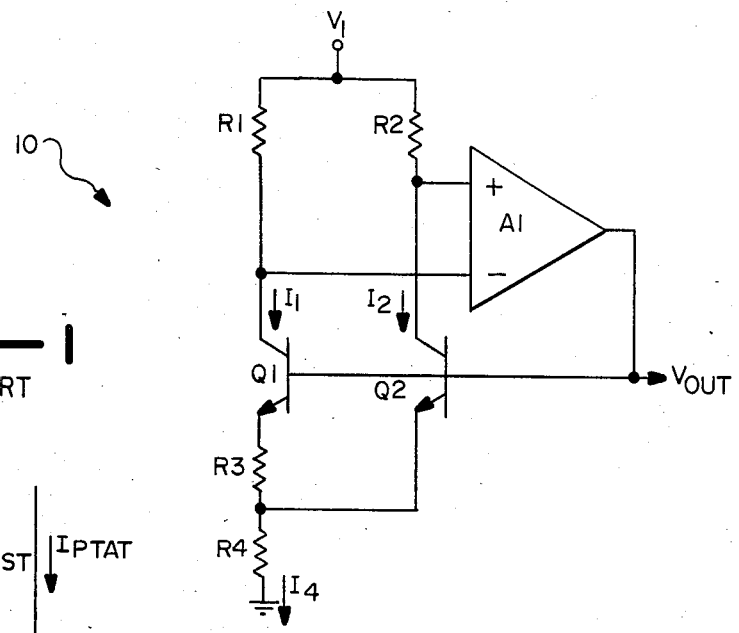
FIG. — 1 PRIOR ART
FIG. 1 is a schematic illustration of a conventional bandgap reference circuit.
Figure 2:
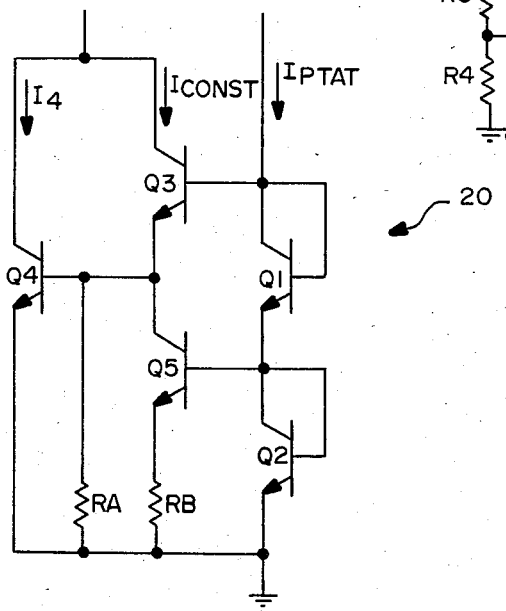
FIG. — 2 PRIOR ART
FIG. 2 is a schematic representation of a conventional circuit which generates a correction current which includes a $T^2$ term.
Figure 4:
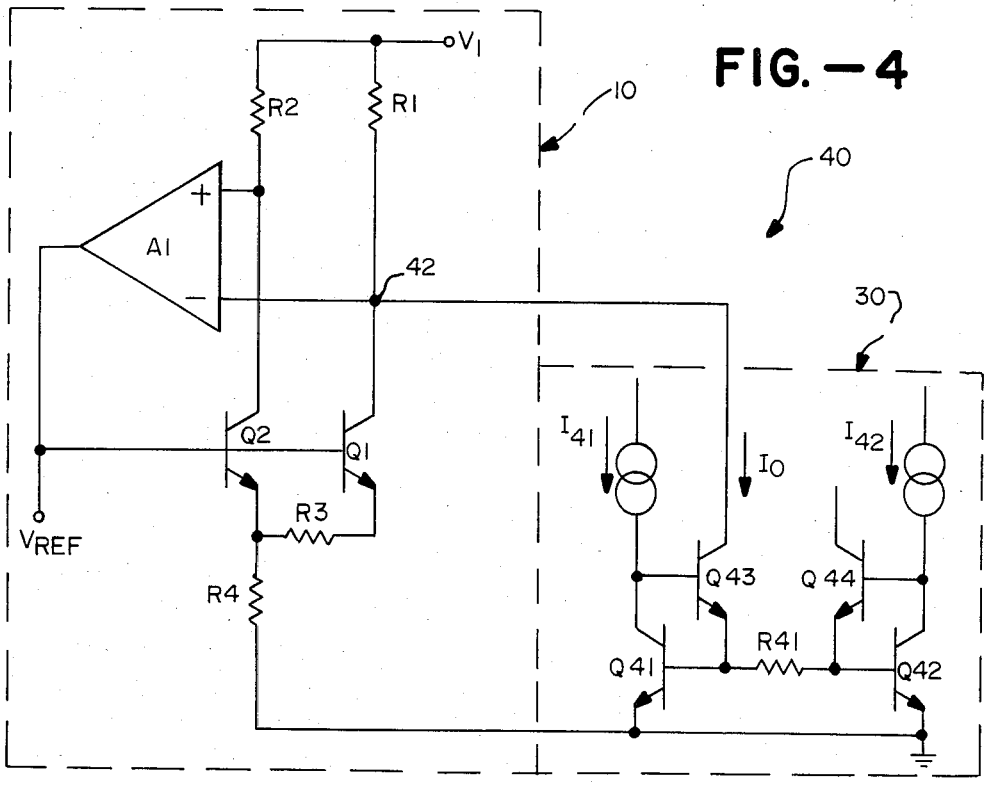
FIG. 4 illustrates the application of the correction circuit of FIG. 3 to the bandgap reference cell shown in FIG. 1.

An example of implementation of the curvature correction circuit 40 is shown in FIG. 4 in which circuit 30 is applied to the Brokaw cell 10 shown previously in FIG. 1. As will be evident from comparing the parabolic form of the correction function of equation (7) with the TlnT error term in the precise mathematical expression (3) for bandgap references, the circuit 30 is well suited for its curvature correction function. This is in contrast to the useful but approximate curvature correction provided by previous correction schemes. The transistors $Q_1$ and $Q_2$ in the Brokaw cell 10 are operated at a current which is proportional to absolute temperature, which makes the effect on output voltage of the correction current added to collector current, independent of temperature. The net effect of correction current $I_o$ of the curvature correction cell 30 is to eliminate the TlnT curvature of the reference 10 and thereby establish linearity in that cell's output, while shifting its zero temperature coefficient operating point from approximately 1.23 volts to approximately 1.19 volts.

In an actual working example of the correction application shown in FIG. 4, $I_{41}$ and $I_{42}$ were 8.3 microamp and 50 microamp, respectively; $A_{41}$ and $A_{42}$ were one square mil and four square mil, respectively, and $R_{41}$ was 5 kohm. Those familiar with the technology will appreciate that this particular set of values is merely exemplary and not limiting. A wide range of values will be derived readily for the current mode circuit of the present invention. In addition, in order to obtain a desired ratio $A_{42}/A_{41}$, a resistor can be placed in series with the emitter of $Q_{41}$ to effectively decrease $A_{41}$. This is particularly useful in those situations where the ratio $A_{42}/A_{41}$ would otherwise require unacceptably large values of $A_{42}$ or unacceptably small values of $A_{41}$.

To summarize, the above parameters are sequentially determined/selected in the context of (1) applying two currents, one of which is IPTAT and the other of which is essentially OTC, as collector currents to two bipolar transistors to generate $\Delta V_{Be}$ across a control resistor and applying the current associated with that resistor as the output curvature correction current to the inverting input of a bandgap reference amplifier; and both (2) selecting the resistor value, and (3) selecting the collector current ratio to be just larger than the transistor area ratio to (4) provide the desired TlnT correction of the appropriate magnitude and form and with the nonlinear curvature component thereof optimized relative to the linear component.

Figure 5:
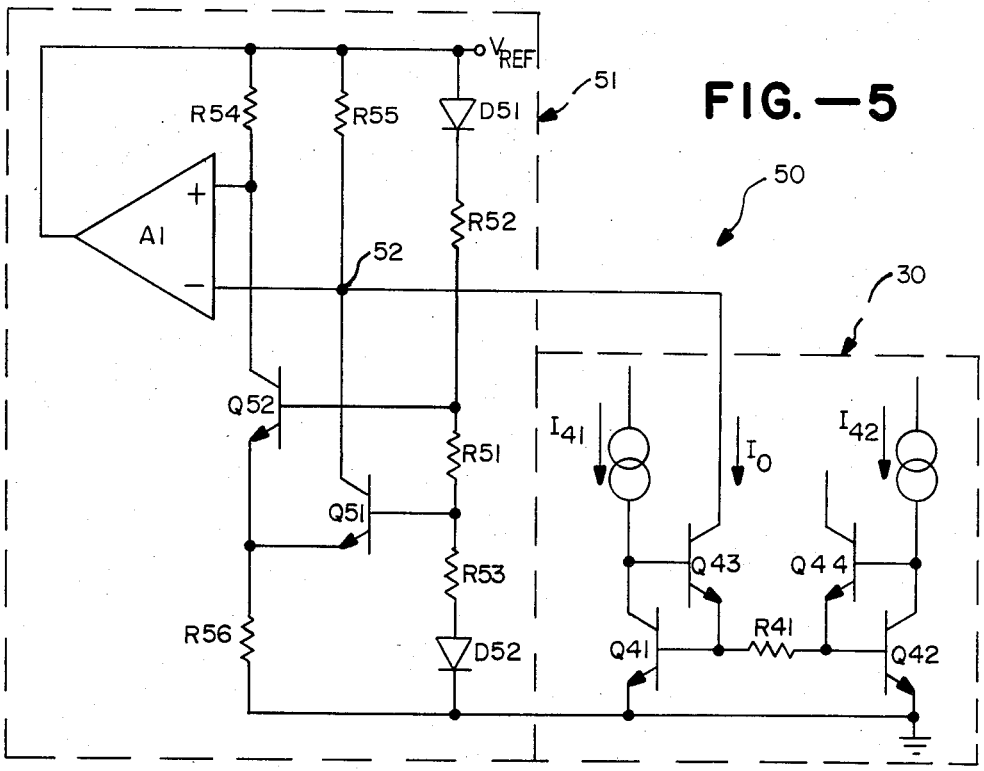
FIG. 5 illustrates the application of the correction circuit of the present invention to still another bandgap reference circuit.

FIG. 5 illustrates another example 50 of the application of the curvature correction circuit 30 of the present invention to a bandgap reference cell, in this case the LM136 circuit which is designated as 51. Illustrating the ease of implementing the correction circuit 30, the circuit is again applied to the inverting amplifier input. The bandgap reference 51 is similar to the previously described Brokaw cell 10 in that transistors Q51 and Q52 have an emitter area ratio of 10:1. Consequently, when small voltages are applied down the resistor divider string R51, R52 and R53, Q51 conducts much more current than Q52, driving the minus input of the amplifier A1 low and the output high, so that the amplifier tends to put more and more voltage across the resistor divider string. Eventually, of course, there is sufficient voltage drop across R51 so that the currents through Q52 and Q51 are equal and the loop stabilizes. At that point, the output of the amplifier stops rising. The overall output voltage, $V_{REF}$, is the summation of the voltage drops $V_{R51}+V_{R52}+V_{R53}+V_{D51}+V_{D52}$, that is, the voltage drops across the three resistors and the two diodes. The voltage drop across R51 is the differential between the two base-emitter voltages of Q51 and Q52 and thus is of the form (KT/q) ln A. The same current through R51 also flows through R52 and R53. The voltage drops across all three resistors are directly proportional to absolute temperature and have a positive temperature coefficient, just as in the Brokaw cell. The voltage drops across D51 and D52 have a negative coefficient. As a result the ratio $(R_{52}+R_{53})/R_{51}$ can be used to offset the negative coefficient of the diode voltage drops and provide essentially a zero temperature coefficient in the output voltage $V_{REF}$, as adjusted by the curvature correction current $I_o$ of the cell 30. In this particular circuit 50 with two diodes D51 and D52, the output reference voltage $V_o$ is approximately 2.5 volts.

From the above description of the curvature correction circuit 30 and the application of the circuit to various bandgap reference circuits, it is readily apparent that the curvature correction circuit provides an output current of the required TlnT form to precisely offset the inherent nonlinearity which exists in even the best bandgap reference circuits. To summarize certain of the key advantages, the curvature correction is provided by a relatively simple circuit which is readily applied to essentially any conventional bandgap reference circuit. The simple correction circuit uses two bipolar transistors and an interconnecting resistance to establish a base-emitter differential current which is of the required TlnT form. Another primary advantage of the present curvature correction circuit resides in the characteristic optimization of the nonlinear correction current component relative to the linear component.

Having thus described a preferred embodiment of my curvature correction circuit and working embodiments of its application to bandgap reference circuits, what is claimed is:

1. A circuit for generating a current which is a known function of temperature, comprising a pair of first and second bipolar transistors having their bases connected across a resistance of selected value R, for providing an output current of selected form across said resistance in response to collector currents applied to the respective transistors, said collector currents being $I_1$, directly proportional to temperature, and $I_2$, whereby said output current across the resistance is of the form $$\frac{KT}{qR}\ln\left(\frac{I_1}{I_2}\ \frac{A_2}{A_1}\right)$$

where

K=Boltzmann's constant

T=Kelvin temperature q=electronic charge $A_1$=emitter area of first transistor $A_2$=emitter area of second transistor;

and means for supplying said collector currents $I_1$ and $I_2$.

2. A circuit having an output current which is of the form TlnT, comprising:

first and second bipolar transistors having emitter areas of ratio $(A_2/A_1)$ and having their bases connected across a resistance of selected value R for providing, in response to respective collector current $I_1$ and $I_2$ applied thereto, a current across the resistance which is is of the form $$\frac{KT}{qR}\ln\left(\frac{I_1}{I_2}\ \frac{A_2}{A_1}\right);$$

the current $I_1$ being proportional to absolute temperature so that the output current is of the general form TlnT; and the area ratio being relatively small and the collector current ratio being selected to be relatively large at a selected operating temperature to provide a relatively large value to the ratio of non-linear and linear components of the logarithmic function.

3. The circuit of claim 2 further comprising a third bipolar transistor having its base and emitter connected across the collector and base of the first transistor to thereby develop a collector current in the third transistor of the said form TlnT.

4. The circuit of claim 2 further comprising a bandgap reference circuit and wherein the collector of the third transistor is connected to the bandgap reference circuit to apply the output current thereto.

5. A bandgap reference circuit having an output which is essentially a linear function of temperature, comprising:

bandgap reference circuit means comprising a first pair of bipolar transistors for generating an output based upon the difference in base-emitter voltages of the transistor pair, plus the base-emitter voltage itself, and an amplifier feedback loop having an output connected in common with the base of the transistor pair and having an inverting input;

first and second bipolar transistors having emitter areas of ratio ($A_2/A_1$) and having their bases connected across a resistance of selected value R for providing, in response to respective collector current $I_1$ and $I_2$ and ratio ($I_1/I_2$) being applied thereto, a current across the resistance which is proportional to absolute temperature, T, and is of the logarithmic form $$\frac{KT}{qR}\ln\left(\frac{I_1}{I_2}\ \frac{A_2}{A_1}\right);$$

the current $I_1$ being proportional to absolute temperature so that the logarithmic component of the output current is of the general form TlnT;

the product area ratio and the collector current ratio being selected to be relatively close to unity at a selected operating temperature to provide a relatively large value to the ratio of non-linear and linear components of the current across R; and a third bipolar transistor having its base and emitter connected across the collector and base of the first transmitter to develop a collector current in the third transistor of the said form TlnT.

6. The circuit of claim 5 further comprising a resistor in series with the emitter of the second transistor for controlling the effective emitter area thereof.

7. A circuit for generating a current of the form TlnT, comprising:

first and second current generators for respectively generating first and second currents $I_1$ and $I_2$, the first current being a linear function of absolute temperature, T;

first and second bipolar transistors having emitter areas $A_1$ and $A_2$ and having their collectors connected at respective nodes to the first and second current generators and having their bases connected at respective nodes across a selected resistance of value R;

a third bipolar transistor having its base connected to the collector node of the first transistor and its emitter connected to the base node of the first transistor for establishing an output current across the third transistor of the form $C_1\mathrm{Tln}(C_2T)$, wherein $$C_1 = \frac{K}{qR},\ C_2 = \ln\left(\frac{I_1}{I_2}\ \frac{A_2}{A_1}\right),$$

and wherein the form of the output current is optimized by selecting the area ratio ($A_2/A_1$) to be relatively small, and selecting the current ratio ($I_1/I_2$) to be relatively large at a selected operating temperature.

8. The circuit of claim 7 further comprising a resistor in series with the emitter of the second transistor for decreasing the effective emitter area thereof.

* * * * *